US005307460A

United States Patent [19]

Garten

[11] Patent Number: 5,307,460

[45] Date of Patent: Apr. 26, 1994

[54] METHOD AND APPARATUS FOR DETERMINING THE EXCITATION SIGNAL IN VSELP CODERS

[75] Inventor: Haim Garten, Haifa, Israel

[73] Assignee: Hughes Aircraft Company, Los Angeles, Calif.

[21] Appl. No.: 835,883

[22] Filed: Feb. 14, 1992

[51] Int. Cl.[5] ..... G10L 9/00

[52] U.S. Cl. ..... 395/2.28

[58] Field of Search ..... 381/29–47; 395/2.28

[56] References Cited

U.S. PATENT DOCUMENTS

| | | | |
|---|---|---|---|
| 4,896,361 | 1/1990 | Gerson | 381/49 |
| 4,907,276 | 3/1990 | Aldersburg | 381/36 |
| 4,963,030 | 10/1990 | Makur | 381/31 |
| 5,208,862 | 5/1993 | Ozawa | 381/36 |
| 5,214,706 | 5/1993 | Minde | 395/2 |

*Primary Examiner*—Michael R. Fleming
*Assistant Examiner*—Michelle Doerrler
*Attorney, Agent, or Firm*—Gordon R. Lindeen, III; William J. Streeter; Wanda K. Denson-Low

[57] ABSTRACT

A new basis vector search process that directly results in an optimal linear weighting for a VSELP (Vector Sum Excited Linear Prediction) coder, thus avoiding the need to perform an extensive search. In the present invention, the conventional search process is replaced by a direct formula, thus avoiding the time consuming searching procedure. Using a simple mathematical relationship, the process of filtering the basis signals with an impulse response filter h(n) every subframe is avoided. A simple theorem has been developed to reduce the computation involved in carrying out the filtering of the basis signals with h(n), and is referred to as the switching convolution theorem. As a result, the computation time necessary to produce the optimal weighting is reduced by a factor of from 3 to 4, while maintaining the output quality of the coder. The new apparatus and method are based upon a set of equations that includes several experimentally justified assumptions. The apparatus and method have been implemented successfully for use in a digital cellular telephone. The present invention reduces of the complexity of VSELP coders while maintaining voice quality comparable to conventional full-search coders.

10 Claims, 2 Drawing Sheets

METHOD AND APPARATUS FOR DETERMINING THE EXCITATION SIGNAL IN VSELP CODERS

BACKGROUND

The present invention generally relates to digital cellular communication systems, and more particularly, to a method and apparatus for determining the excitation signal in vector sum excited linear prediction (VSELP) coders used in such systems.

The present invention addresses the code search process that is the heart of all voice coders based upon CELP (code excited linear prediction) processing, and in particular a subgroup of the CELP coder known as a VSELP (vector sum excited linear prediction) coder. The voice coder selected recently as the standard for the digital cellular telecommunication (IS-54) specification is based upon this VSELP process. The IS-54 standard is officially known as the EIA/TIA Interim Standard, "Cellular System Dual-Mode Mobile Station—Base Station Compatibility Standard," published by the Electronic Industries Association.

The only known search method employing VSELP coding is based upon a Motorola code search routine as is stated in the IS-54 standard for the dual mode digital cellular communication system specification. The disadvantage of this method is its extensive computation time, which requires a fast, relatively expensive processor to implement.

The computation power needed to implement a conventional coder is about 25 Mips for the transmitter. This is mainly due to the conventional code search process that takes up about 47% of the computational time. The main goal in this search is to derive a signal that is a linear combination of a set of basis signals. In order to find the optimal weighting of the basis signals, the conventional search process scans all the possible weightings and a linear combination of weightings satisfying a certain criteria is selected.

More particularly, speech is modeled as an output of a periodic signal (pitch) that excites a cascade of filters that shape the spectrum. This model is the basis of the coding algorithm. It consists of three analysis stages: in the first, a model of the current speech frame is derived. This model is based upon the common linear prediction method, wherein a set of parameters is derived to minimize the error between the model and the signal. The first stage is followed by a second analysis procedure wherein the pitch period (or lag) is estimated. A residual signal, which is the error between the model and the real signal is then derived. The residual signal serves as an input to the third stage, wherein an analysis by synthesis approach is used to select, from a given codebook of residuals, the best one that matches that residual signal. The index of the selected residual is then transmitted along with the linear prediction parameters and the pitch lag. Since both the transmitter and receiver use an identical codebook, the residual is reconstructed, exciting a cascade of synthesis filters whose paramters are the linear prediction coefficients. The output of the filters is the reconstructed speech.

The standard approach assumes that all possible excitation signals (residuals) are derived by combining two signals $f_1(n)$ and $f_2(n)$. Each one of these signals is comprised of a linear combination of 7 basis signals, where the coefficients of the linear combination are constrained to be $+1$ or $-1$. The two signals excite the synthesis filters resulting an output voice which is hopefully a best replica of the original voice signal. By saying "best" what is meant is that no audible degradation is noticed. This is accomplished by weighting the error to be minimized with a weighting filter w(z) that takes into account the perceptual mechanism of hearing. Assuming a subframe of N samples long the general form of the error to be minimized in order to find $f_1(n)$ and $f_2(n)$ is:

$$E = \sum_{n=0}^{N-1} (P(n) - \gamma f_i(n))^2$$

where:

$$f_i(n) = \sum_{m=0}^{7} \theta_m q_m(n);\ \theta_m = +1 \text{ or } -1$$

and the signals $q_m(n)$ are the basis signals $V_m(n)$ and $\gamma$ is a gain factor. In addition, the signals are decorrelated. In every subframe, the optimization of the equation for E is done twice since two sets of basis signals are selected. Consequently, two sets of basis signals are convolved (each set consists of 7 signals, 40 samples long) with a recursive filter h(n) having length 10. This imposes a heavy load on the processor.

In order to find the optimal signal $f_i(n)$ all combinations of $\theta_m$($2^7$ combinations) are computed and the best one is found. Since, for each word of 7 bits there is an optimal gain term $\gamma$ as well, the resulting search procedure requires additional computational resources.

The main goal in this search is to derive a signal that is a linear combination of a set of basis signals. In order to find the optimal weighting of the basis signals, the conventional search process scans all the possible weightings and a linear combination of weightings satisfying a certain criteria is selected.

Therefore, it is an objective of the present invention to provide a processing apparatus and method which reduces the complexity of conventional VSELP coders while maintaining voice quality, and thus improves the processing performance of such VSELP coders.

SUMMARY OF THE INVENTION

In the present invention, a new search process is employed that directly results in an optimal linear weighting, thus avoiding the need to perform the above search process. In the present invention, the search process is replaced by a direct formula, thus avoiding the searching procedure. In addition, by using a simple mathematical relationship described herein, the process of filtering the basis signals with h(n) every subframe is avoided. A simple theorem has been derived to reduce the computation involved in carrying out the filtering of the basis signals with h(n). It is referred to as the switching convolution theorem (SCT). As a result, the computation time necessary to produce the optimal weighting is reduced by a factor of from 3 to 4 while maintaining the output quality of the coder. The new apparatus and method is based upon a set of equations that includes assumptions made and justified experimentally. The apparatus and method has been implemented successfully for use in a digital cellular telephone.

More particularly, the present invention comprises a vector sum excited linear prediction coder for use in a digital cellular telephone including a transmitter and a receiver. The coder comprises an analog-to-digital converter for converting analog speech input signals into digital speech signals. A first memory is coupled to the analog-to-digital converter for storing the digital speech signals. A second memory is provided for storing a plurality of predefined sets of basis vector signals. A signal processor is coupled to the first and second memories for generating a plurality of codewords comprising a linear combination of binary coefficients derived from the digital speech signals and the plurality of predefined sets of basis vector signals, and wherein the codewords are representative of the respective binary weightings of the plurality of sets of basis vectors, and wherein the codewords are computed using a predetermined switching convolution theorem and the respective binary weightings are determined by the sign of predetermined equations. The codewords are applied to the transmitter for communication to the receiver, and whereupon the receiver is adapted to convert the codewords into a recreation of the analog speech input signals.

The coder and method of the present invention comprise a processing procedure that implements the equation $\theta_m{}^I = \text{SIGN}\ \{ccp(m) - \alpha(m)CR\}$; $m = 1 \ldots 7$, to compute the first set of codewords, where $$ccp(m) = \sum_{n=0}^{N-1} p^{\wedge}(n) V_1(m, N-1-n);\ m = 1 \ldots 7$$

where $p^{\wedge}(n) = p(N-1-n) \times h(n) = Xa(n)$, and $V_1(m, N-1-n)$ is a mirror signal of the first set of basis vector signals, where $\times$ is the convolution operator $$\alpha(m) = \sum_{n=0}^{N-1} V_1(m, N-1-n) b^{\wedge}(n) / \Gamma_{b'}$$

where $b^{\wedge}(n) = b'(m, N-1-n) \times h(n)$, and $$\Gamma_{b'} = \sum_{n=0}^{N-1} b'(n) b'(n)$$

$$CR = \sum_{n=0}^{N-1} p(n) b'(n), \text{ and the equation}$$

$$\theta_m{}^H = \text{SIGN}\left\{ \sum_{n=0}^{N-1} Xa(n) V_2(m, N-1-n) - \delta(m) \sum_{n=0}^{N-1} Xa(n) X1(N-1-n) + CR(\delta(m)a - \beta(m)) \right\}$$

$m = 1 \ldots 7$, to compute the second set of codewords, where $V_2(m, N-1-b))$ is the second set of basis vector signals, $$\beta(m) = \sum_{n=0}^{N-1} V_2(m, N-1-n) b^{\wedge}(n) / \Gamma_{b'};\ m = 1 \ldots 7$$

$$a = \sum_{m=1}^{7} \theta_m{}^I \alpha(m)$$

$$X1(n) = \sum_{m=1}^{7} \theta_m{}^I V_1(m, n)$$

$$Pout(n) = X1(n) x h(n)$$

$$cs = \sum_{n=0}^{N-1} Pout(n) b'(n)$$

-continued $$\Gamma_z = \sum_{n=0}^{N-1} Pout^2 - a^2 \Gamma_{b'}$$

$$\delta(m) = \sum_{n=0}^{N-1} (Pout^{\wedge}(n) V_2(m, N-1-n) - \beta(m) cs) / \Gamma_z;\ m = 1 \ldots 7,$$

$Pout^{\wedge}(n) = Pout(N-1-n) x h(n)$, and $x$ is the convolution operator.

The purpose of the invention is to reduce the complexity of conventional VSELP coders while still maintaining comparable voice quality. As a result, the cellular telephone incorporating the present invention is less expensive to manufacture than conventional VSELP coders. In addition, the present apparatus and method may be used in other applications utilizing a VSELP coder. These other applications include voice message systems, for example. In the context of the cellular telephone, for a given processing power, more features may be added to the telephone that incorporates the present invention, such as voice recognition for hands free dialing, noise cancellation, and so forth, for substantially the same cost as cellular telephones incorporating conventional VSELP coders.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
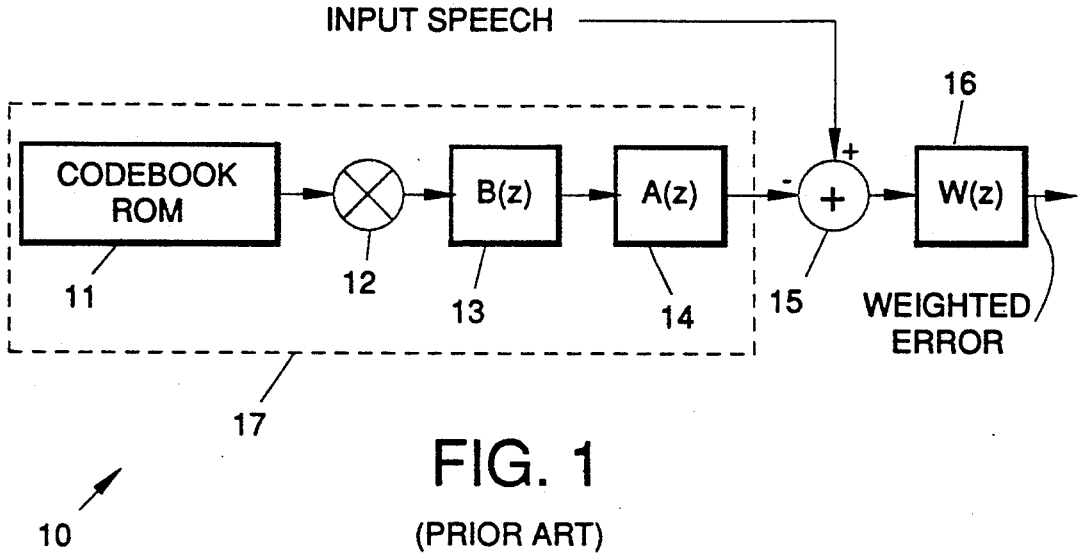
FIG. 1 (PRIOR ART)
FIG. 1 illustrates a conventional VSELP coder block diagram.

Referring to the drawing figures, the present invention comprises a method and means of determining the excitation signal in VSELP (vector sum excited linear prediction) coders. The VSELP coder is a member of a class of voice coders known as code excited linear predictive coding (CELP). For reference purposes, a conventional approach to the design of a CELP coder 10 is shown in FIG. 1 and described below.

With reference to FIG. 1, the conventional CELP coder 10 is comprised of a codebook read only memory (ROM) 11 that includes a set of codes, or basis vectors. The output of the codebook ROM 11 is passed through a multiplier 12 to a plurality of cascaded filters 13, 14. The output from the second filter 14 is combined in a summing device 15 with the speech signal. A third filter 16 generates a weighted error signal to be minimized.

According to conventional principles, the speech signal is modeled as an output from the cascade of digital filters 13, 14 excited by an excitation signal with proper scaling. The modeling of the speech is comprised of two stages: first, deriving the digital filters 13, 14(B(z), A(z)) and second, deriving the proper excitation signal (from the codebook ROM 11). The first filter 13 (B(z)) is a so called "long term filter" or "pitch filter" that controls the pitch period, while the second filter 14(A(z)) is a "short term predictor" that controls the spectral shape of the speech. Those two filters 13, 14 are derived, on a frame by frame basis, using conventional methods of linear prediction and autocorrelation and will not be discussed in detail herein. Once B(z) and A(z) have been determined, the excitation signal is selected from the codebook ROM.

In the CELP coder 10 the codebook ROM 11 is comprised of many possible excitation signals from which an optimal excitation is selected using an exhaustive search. A full search through all the $2^M$ combinations of ROM value takes place that results in selecting the combination that minimizes the total weighted error provided as an output signal from the third filter 16. The optimal binary combination forms a codeword M bits long, which is then transmitted to the voice synthesizer along with additional parameters. As was mentioned above, this procedure requires a fast, relatively expensive processor.

The present invention avoids the need to implement the conventional search process since an optimal linear combination is found directly by checking the sign of an arithmetic expression. In addition, the processing required for the present coder is more suitable for implementation by fixed point processor, which results in better performance. As a result, a 12 Mips, 16 bit fixed point processor may be used, avoiding the need to use an expensive 25 Mips machine as is required in the conventional coder 10.

Figure 2:
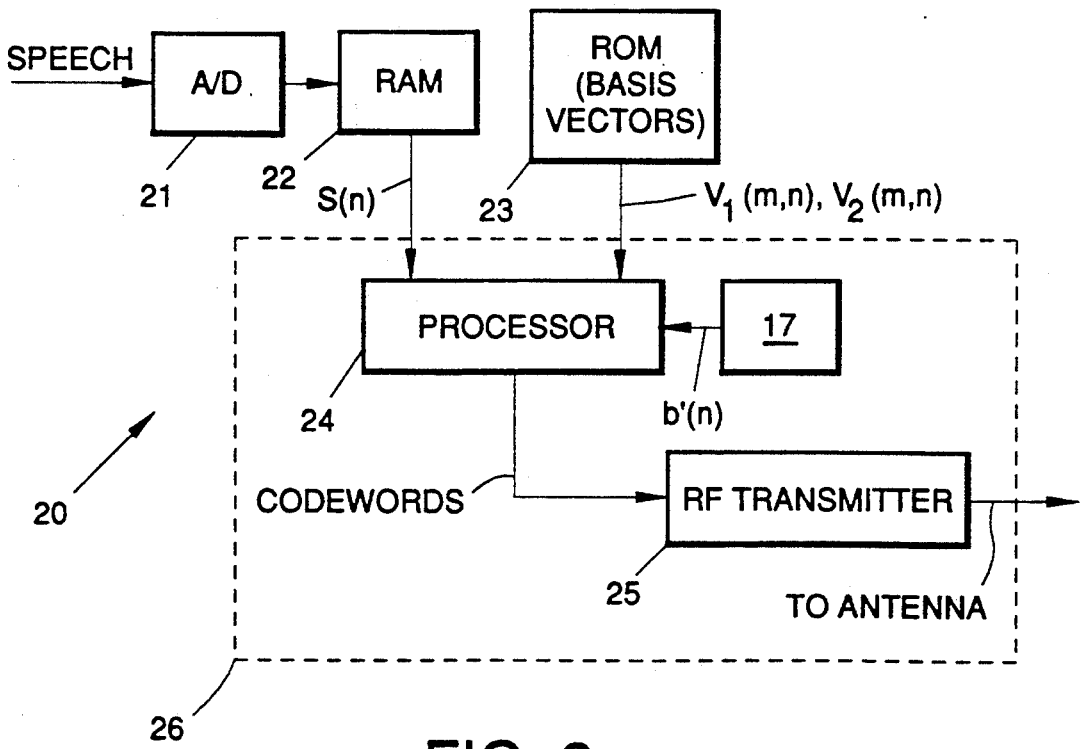
FIG. 2 illustrates a block diagram of an implementation of a codebook search apparatus and procedure implemented in accordance with the principles of the present invention.

FIG. 2 shows a diagram of a codebook search apparatus 20 and method implemented in accordance with the principles of the present invention. The codebook search apparatus 20, or VSELP coder 20, is comprised of an analog to digital (A/D) converter 21, that is coupled to a random access memory (RAM) 22 whose output is coupled to a computer processor 24. A read only memory (ROM) 23 is also coupled to the processor 24 and stores basis vectors therein. The ROM 23 may also be comprised of a RAM that is loaded from a ROM, such as an EEPROM, for example. The processor 24 is adapted to determine the proper codewords for a speech input signal applied to the A/D converter 21 and stored in the RAM 22, and provide the codewords as output signal therefrom that are applied to a transmitter 25. The processor 24 and transmitter 25 may be a single integrated circuit device 26, for example. In the VSELP coder 20, the ROM 23 only stores a set of M basis signals (or vectors), while a linear combination of the basis signals having binary coefficients (+1 or −1) serves as an excitation signal.

The block diagram in FIG. 2 illustrates the implementation of the present coder 20. The analog speech signal is converted into digital form by the A/D converter 21 at a rate of 8000 samples/second and the digitized signal is stored in the RAM 22. The ROM 23 is comprised of two sets of basis vectors (Table 2.1.3.3.2.6.4-1 in the IS-54 specification). Both the RAM 22 and ROM 23 provide inputs to the processor 24 that then uses the above method to generate two codewords every 5 milliseconds. The codewords are transmitted, along with additional data, to the receiver synthesizer that generates the proper excitation signal for the voice synthesis from the codewords.

The present apparatus and method have several advantages. The computation time is about 25%–30% of the respective time required by the conventional code search as shown in FIG. 1. Also, the present invention is more readily adapted for a fixed point processor implementation than the coder 10 (it requires very few long word calculations).

The present coder 20 (along with additional modifications) has been implemented successfully on a 12-Mips, 16 bit fixed point machine (the conventional coder 10 requires at least a 25 Mips machine to perform properly. The present coder 20 is operative, built to the IS-54 digital cellular telecommunication specifications, and has provided good output speech quality, as will be detailed below.

The following define the terms that are employed in the equations discussed herein:

$$w(z) = \frac{1 - \sum_{i=1}^{N_p} a_i z^{-i}}{1 - \sum_{i=1}^{N_p} a_i \lambda^i z^{-i}} \text{ is the weighting filter } w(z),$$

Np is the prediction order, $a_i$ are the linear prediction coefficients,

λ is a fraction (in most cases, λ=0.8), $V_1(m, n, V_2(m, n); m=1 \ldots 7, n=0 \ldots 30)$ are the two sets of basis signals, h(n) is the impulse response of the filter H(z) where:

$$H(z) = \frac{1}{1 - \sum_{i=1}^{N_P} a_i \lambda^i z^{-i}}$$

p(n) is the speech input S(n) convolved by h(n),

B(z)=

$$\frac{1}{1 - Bz^{-L}}$$

is the pitch filter whose impulse response is b(n), where L is the pitch lag, h'(n)=h(n)×h(n), × is the convolution operator, SIGN(x)=1 if x>0 and −1 if x<0, and N is the subframe length (40 samples in the IS-54 standard).

The general theory underlying the present invention will now be discussed. The basic concept of the present invention is to replace the searching process with a direct formula deriving the binary coefficients $\theta_m$. Based on that, the switching convolution theorem is used to further reduce the computation load. Several assumptions are made in order to achieve this goal. Since no audible degradation has been noticed (at least in a noise free channel), the approach appears to work well.

The first assumption is that the basis signals Vm(n);m=1,7 (for both sets) are substantially orthogonal, meaning:

$$\sum_{n=0}^{N-1} V_n(n) V_j(n) = 0, \text{ if } m \neq j$$

This was found to be substantially true with the current two sets of basis signals. As a result, the convolved basis signals $q_m(n)$ are orthogonalized as well.

The present code search procedure finds a set of weights $\{a_i\}$ minimizing the following criteria:

$$E=\Sigma_n[p(n)-\lambda\Sigma_i a_i q_i(n)]^2$$

Since both p(n) and $q_i(n)$ are the output of an optimal weighting filter, the subjective effect of this error is minimized as well.

The set $\{a_i\}$ transmitted to the receiver, takes on only binary values $\pm 1$. The conventional approach was to do an exhaustive search over all the combination of $\{a_i\}$ selecting the one minimizing E. The present approach is to analytically solve it for the proper combination of $\{a_i\}$ by making some assumptions. Given an explicit expression for the set $\{a_i\}$, further improvement has been made using the switching convolution theorem derived herein, causing an additional drop in processing time.

The approach and assumptions are presented below. At first, no constraints are imposed on the coefficients $\{a_i\}$ and an optimal solution is derived. Given an explicit expression for the coefficients, a hard limiter is then applied resulting in the binary set $\{a_i\}$.

In order to minimize the equation for E the derivative with respect to the set $\{a_i\}$ is set to zero:

$$\Delta E/\Delta a_m=\Sigma[p(n)-\lambda\Sigma_i a_i q_i(n)][\lambda q_m(n)+\lambda'\Sigma_i q_i(n)]=0$$

where $\lambda'$ is the derivative of the gain $\lambda$ with respect to $a_m$However, the optimal gain can be found easily by setting the derivative of E with respect to $\lambda$ to zero. This yields:

$$\lambda=\Sigma_n p(n)\Sigma_i a_i q_i(n)/\Gamma$$

where $\Gamma=\Sigma_n(\Sigma_i\ a_i q_i(n)^2$ is the energy term. Denote $\psi(p,q_m)=\Sigma_n p(n)q_m(n)$ to be the cross correlation between p(n) and $q_m(n)$.

In order to simplify the above equation for E above the following assumption is made. The basis signals $v_m(n)$ (for both sets) are orthogonal, meaning:

$$\psi(v_m,v_j)=G\delta(m-j)$$

where $\delta(x)$ is the Dirac delta function and G is a gain factor. Since $q_m(n)$ is the convolution of $v_m(n)$ with the linear filter h(n) the orthogonality applies to the signals $q_m(n)$ as well, and the equation defining $\Delta E/\Delta a_m$ can be simplified to yield:

$$\lambda\psi(p,q_m)=\lambda^2 a_m\psi(q_m,q_m)=0.$$

The optimal $a_m$ becomes:

$$a_m=\psi(p,q_m)/\psi\lambda(q_m,q_m).$$

Since both $\lambda$ and $\psi(q_m,q_m)$ are greater than 0 and $a_m$ takes only binary values, then:

$$a_m=\mathrm{SIGN}(\psi(p,q_m)); m=1, 2, \ldots 7.$$

The idea above along with the switching convolution theorem form the basis for the computation savings provided by the present invention.

The IS-54 standard that implements the VSELP procedure requires a decorrelation process between $q_m(n)$ and b'(n) to take place (b(n) is the impulse response of the pitch predictor filter). It is assumed that q'(n) the decorrelated signals are orthogonal as well. Consequently, the above equation for $a_m$ is used. This is the second assumption that is made. Thus to summarize, two assumptions are made: (1) the basis signals $v_m(n)$ for both sets are orthogonal and (2) the decorrelated signals $q'_m(n)$, $q''_m(n)$ are also orthogonal.

Justification for the assumptions are presented below. The first assumption was found to be generally true, in that the cross correlation ratio (absolute value) satisfies the equation:

$$\psi(v_m,v_j)/\psi(v_m,v_m)<1 \text{ for } m\neq j$$

for both sets of basis signals as given in the IS-54 standard. This has been easily confirmed by conducting the various cross correlations. The above ratio was found to be less than 0.2. The second assumption is that the decorrelated basis signals are orthogonal as well. This was justified experimentally by checking various speech segments. From the speech segments the signal b'(n) has been extracted, the signals:

$$q'_m(n)=q_m(n)-a_m b'(n);\ m=1,2, \ldots 7$$

were found to be practically orthogonal. The validity of the orthogonality can also be analytically proven. From the above equation for $q'_m(n)$, $$\psi(q'_m,q'_j)=\psi(q_m,q_j)-a_m a_j\Gamma$$

where $a_m$ and $a_j$ are the normalized cross correlation factors respectively. In general, both are less than 1, thus allowing us to neglect the last term in the equation. As a result, if the set $\{q_m\}$ is orthogonal, this implies the set $\{q'_m\}$ is orthogonal as well. The same holds true for the sets $\{q'_m\}$ and $\{q''_m\}$.

The details of the present method that are implemented in the coder 20 are presented below. The following derivation is based upon the IS-54 standard for the dual mode cellular system specification. According to the IS-54 standard, there are two sets of basis vectors, each comprising 7 signals. Every 5 milliseconds, a selection of two codewords is made. These two codewords represent the respective binary weightings of the two sets of basis vectors. The sum of the two codewords (along with proper scaling) is the excitation signal.

A simple theorem has been derived to reduce the computation involved in carrying out the filtering of the basis signals with h(n), the impulse response of the poles only of the filter w(z), as will be described in detail below. It is referred to as the switching convolution theorem (SCT). This theorem is used later in the description of the present invention.

Given a vector $b'(n)=b(n)\times h(n)$, where $\times$ is a convolution operator, then $$\sum_{n=0}^{N} a_n b_n' = \sum_{n=0}^{N} a^{\wedge}(n) b^{\wedge}(n)$$

where:

$a^{\wedge}(n)=a(N-n)\times h(n)$ and $b^{\wedge}(n)=b(N-n)$

Proof: From $b'(n)=b(n)\times h(n)$, $b'(0)=h(0)b(0)$ $b'(1)=h(0)b(1)+h(1)b(0)$ $b'(2)=h(0)b(2)+h(1)b(1)+h(2)b(0)$ $b'(3)=h(0)b(3)+h(1)b(2)+h(2)b(1)+h(3)b(0)$, and so forth.

Multiplying each row by the respective a(n) and rearranging terms, the cross correlation C becomes:

$$C = b(0)[h(0)a(0) + h(1)a(1) + h(2)a(2) + h(3)a(3) + \ldots] + b(1)[h(0)a(1) + h(1)a(2) + h(2)a(3) + \ldots] + b(2)[h(0)a(2) + h(1)a(3) + \ldots] + b(3)[h(0)a(3) + \ldots] + \ldots.$$

The terms in the brackets are the output of convolving the sequence:

$$\ldots a(3), a(2), a(1), a(0) \text{ with } h(n).$$

The advantage of using the above switching convolution theorem is clear, since there is no need to carry out the convolution of the basis signals with h(n). Switching it to the second argument of the cross correlation (for example, p(n)) it is only done one time instead of 14 times.

The following terms are used in deriving the equations employed in the present method: $\times$ is the convolution operator; h(n) is the impulse response of the filter A(z); b(n) is the impulse response of the filter B(z); $b'(n)=b(n)\times h(n)$; p(n) is a weighted version of the input speech S(n); and $V_1(m,n)$, $V_2(m,n)$, $m=1 \ldots 7$, $n=0, \ldots 39$ are the two sets of basis vectors, with each set comprising 7 vectors that are 40 samples long.

Figure 3:
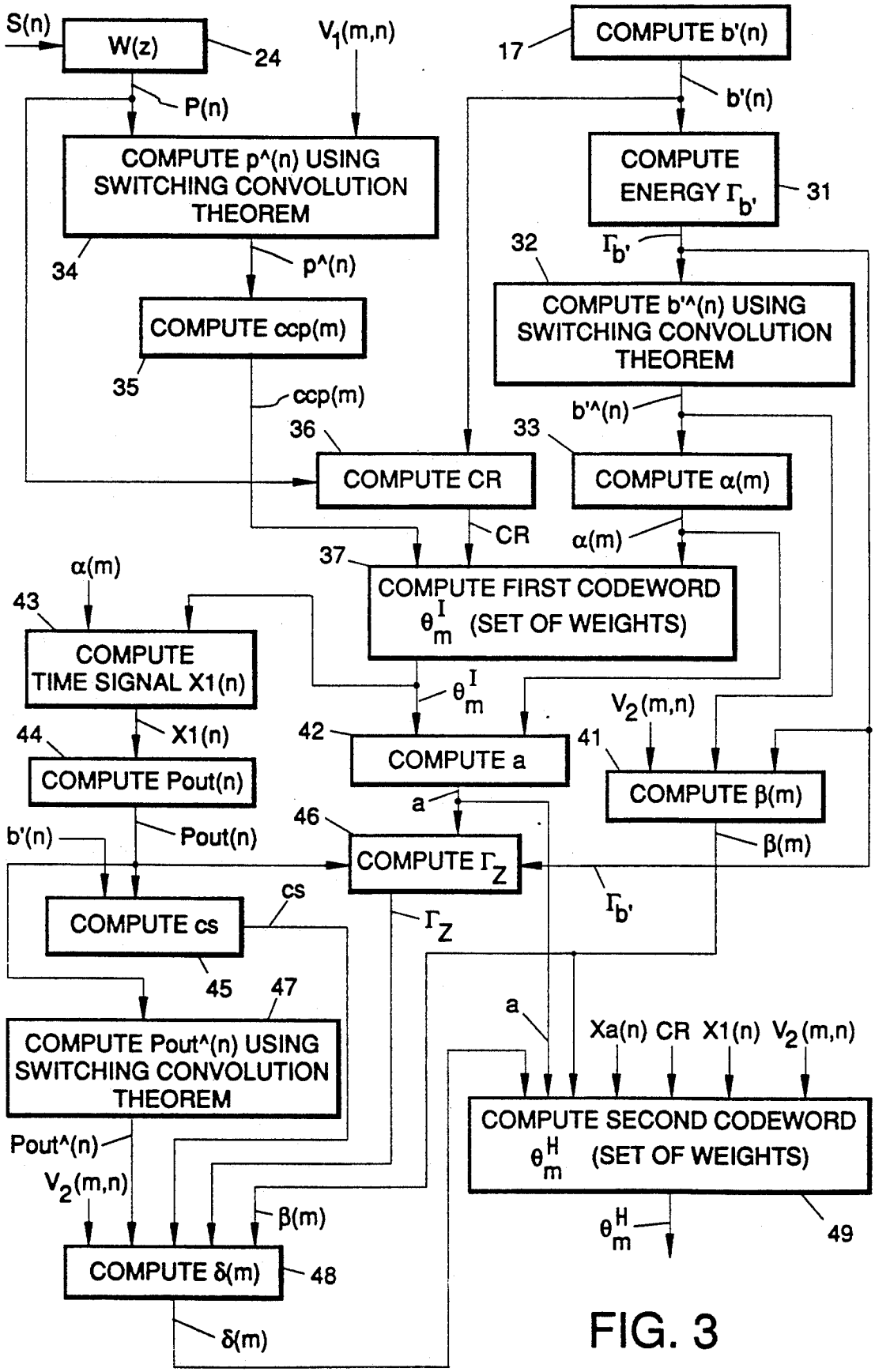
FIG. 3 illustrates a flow diagram indicative of a processing apparatus and method in accordance with the principles of the present invention.

FIG. 3 illustrates a flow diagram indicative of a processing apparatus and method in accordance with the principles of the present invention. The present method is comprised of the following steps, and is implemented in the apparatus:

The first task comprises finding the first codeword, $\theta_m^I$. This is accomplished by the following steps. First determine an energy term, $\Gamma_{b'}$, defined by $$\Gamma_{b'} = \sum_{n=0}^{N-1} b'(n)b'(n)$$

as indicated in step 31, after b'(n) is computed as indicated in box 17. Derive a first cross correlation factor, $\alpha(m)$, defined by $$\alpha(m) = \sum_{n=0}^{N-1} V_1(m,N-1-n)b^{\wedge}(n)/\Gamma_{b'}$$

as indicated in step 33, where $b^{\wedge}(n)=b'(m,N-1-n)\times h(n)$, as indicated in step 32.

Determine ccp(m), defined by $$ccp(m) = \sum_{n=0}^{N-1} p^{\wedge}(n)V_1(m,N-1-n);\ m = 1 \ldots 7$$

as indicated in step 35, where $p^{\wedge}(n)=p(N-1-n)\times h(n)=Xa(n)$, as indicated in step 34.

Determine CR, defined by $$CR = \sum_{n=0}^{N-1} p(n)b'(n), \text{ as indicated in step 36.}$$

Therefore, $\theta_m^I$ is determined by $$\theta_m^I = \text{SIGN}\{ccp(m)-\alpha(m)CR\};\ m=1 \ldots 7, \text{ as indicated in step 37.}$$

The next task is to find the second set of codewords $\theta_m^H$. This is accomplished by the following steps. Derive a second cross correlation factor, $\beta(m)$, defined by $$\beta(m) = \sum_{n=0}^{N-1} V_2(m,N-1-n)b^{\wedge}(n)/\Gamma_{b'};\ m = 1 \ldots 7$$

as indicated in step 41, where $b^{\wedge}(n)$ and $\Gamma_{b'}$ have been derived above.

Define and compute:

$$a = \sum_{m=1}^{7} \theta_m^I \alpha(m), \text{ as indicated in step 42.}$$

Then, $$X1(n) = \sum_{m=1}^{7} \theta_m^I V_1(m,n), \text{ as indicated in step 43.}$$

Define and compute:

$$Pout(n) = X1(n) \times h(n), \text{ as indicated in step 44,}$$

$$cs = \sum_{n=0}^{N-1} Pout(n)b'(n), \text{ as indicated in step 45, and}$$

$$\Gamma_z = \sum_{n=0}^{N-1} Pout^2 - a^2\Gamma_{b'}, \text{ as indicated in step 46.}$$

Derive $\delta(m)$:

$$Pout^{\wedge}(n) = Pout(N-1-n) \times h(n), \text{ as indicated in step 47, and}$$

$$\delta(m) = \sum_{n=0}^{N-1} (Pout^{\wedge}(n)V_2(m,N-1-n) - \beta(m)cs)/\Gamma_Z;\ m = 1 \ldots 7$$

as is indicated in box 48. Therefore;

$$\theta_m^H = \text{SIGN}\left\{ \sum_{n=0}^{N-1} Xa(n)V_2(m,N-1-n) - \delta(m) \sum_{n=0}^{N-1} Xa(n)X1(N-1-n) + CR(\delta(m)a - \beta(m)) \right\}$$

for $m=1 \ldots 7$, as is indicated in box 49.

The above-described apparatus and method have been tested in order to check the subjective quality of the voice. Listening to the output from both the IS-54 standard system and the present invention, no degradation was noticed. It was very hard to notice any difference in the quality between the present method and the full exhaustive search. Objective measures of the signal-to-noise ratio at the output of the receiver showed a decrease of less than 0.25 dB in comparison with the full exhaustive search, which is relatively insignificant. The typical signal-to-noise ratio of the voice output was about 10 dB, and as a result, the objective degradation measure is about 2.5%. One possible explanation of the results is that all the processing noise is shaped by the filter weighting whose task is to shift the noise into the formant regions (peaks of the speech spectrum) where a high signal-to-noise ratio exists. In terms of computation load, the code search time has been reduced by a factor of at least 3, leading to a total saving of over of 30%.

Thus there has been described a new and improved method and apparatus for determining the excitation signal in vector sum excited linear prediction coders. It is to be understood that the above-described embodiment is merely illustrative of some of the many specific embodiments that represent applications of the principles of the present invention. Clearly, numerous and other arrangements can be readily devised by those skilled in the art without departing from the scope of the invention.

What is claimed is:

1. A vector sum excited linear prediction coder, said coder comprising:

an analog-to-digital converter for converting analog audio input signals into digital audio signals;

a first memory coupled to the analog-to-digital converter for storing the digital audio signals;

a second memory for storing a plurality of predefined sets of basis vector signals; and a signal processor coupled to the first and second memories for generating a plurality of codewords derived from the digital audio signals and the plurality of predefined sets of basis signals, wherein the codewords are representative of respective binary weightings of the plurality of sets of basis vector signals, and wherein the respective binary weightings are determined by the sign of predetermined equations which employ a predetermined switching convolution theorem.

2. The coder of claim 1 wherein the signal processor generates the plurality of codewords using a predetermined switching convolution therorem that provides for filtering the basis vector signals with a predetermined filter (h(n)) a single time.

3. The coder of claim 1 wherein the signal processor generates the codewords $\theta^l{}_m$ by determining the sign of the following predetermined equation $$\theta^l{}_m = \text{SIGN}\ \{ccp(m) - \alpha(m)CR\}$$

m=1 . . . 7, for a first set of codewords, where $$ccp(m) = \sum_{n=0}^{N-1} p^{\wedge}(n)V_1(m.N-1-n):\ m = 1 \ldots 7$$

where $p^{\wedge}(n) = p(N-1-n) \times h(n) = Xa(n)$, and $V_1(m,N-1-n)$ is the mirror signal of a first set of the plurality of sets of basis vector signals, $$\alpha(m) = \sum_{n=0}^{N-1} V_1(m.N-1-n)b^{\wedge}(n)/\Gamma_{b'}$$

where $b^{\wedge}(n) = b'(m,N-1-n) \times h(n)$, $b'(m,N-1-n) = b(m,N-1-n) \times h(n))$ p(n) is a weighted version of the digital audio speech signals, h(n) is a predetermined filter, and $$\Gamma_{b'} = \sum_{n=0}^{N-1} b'(n)b'(n)$$

$$CR = \sum_{n=0}^{N-1} p(n)b'(n),$$

where $b'(n) = b(n) \times h(n)$ and the equation $$\theta_m{}^H = \left\{ \text{SIGN} \sum_{n=0}^{N-1} Xa(n)V_2(m.N-1-n) - \delta(m) \sum_{n=0}^{N-1} Xa(n)X1(N-1-n) + CR(\delta(m)a - \beta(m)) \right\}$$

m=1 . . . 7, for a second set of codewords, where $V_2(m,N-1-n)$ is the mirror signal of the second set of the plurality of sets of basis vector signals, $$\beta(m) = \sum_{n=0}^{N-1} V_2(m.N-1-n)b^{\wedge}(n)/\Gamma_{b'};\ m = 1 \ldots 7$$

$$a = \sum_{m-1}^{7} \theta_m{}^I\alpha(m)$$

$$X1(n) = \sum_{m-1}^{7} \theta_m{}^I V_1(m.n)$$

$$Pout = X1(n) \times h(n)$$

$$CS = \sum_{n=0}^{N-1} Pout(n)b'(n)$$

$$\Gamma_z = \sum_{n=0}^{N-1} Pout^2 - a^2\Gamma_{b'}$$

$$\delta(m) = \sum_{n=0}^{N-1} (Pout^{\wedge}(n)V_2(m.N-1-n) - \beta(m)cs)/\Gamma_z;$$

$$m = 1 \ldots 7,$$

$$Pout^{\wedge}(n) = Pout(N-1-n) \times h(n), \text{ and}$$

$x$ is the convolution operator.

4. The coder of claim 1 wherein the analog audio signals comprise analog speech signals.

5. The coder of claim 1 further comprising a transmitter for communicating the codewords to a cellular telephony receiver.

6. A method for use in vector sum excited linear prediction encoding of audio input signals comprising:

converting the analog audio input signals into digital audio signals;

storing the digital audio signals in a first memory;

generating a plurality of codewords representative of respective weightings of a plurality of predefined sets of basis vector signals and which are derived from the digital audio signals and the plurality of predefined sets of basis vector signals by determining the sign of predetermined equations which employ a predetermined switching convolution theorem.

7. The method of claim 6 wherein the step of generating the plurality of codewords using a predetermined switching convolution theorem comprises the step of filtering the basis signals with a predetermined filter (h(n)) a single time.

8. The method of claim 6 wherein the step of determining the sign of predetermined equations comprises implementing the equation $\theta_m = \text{SIGN}\ \{ccp(m) - \alpha(m)CR\}$; m=1 . . . 7, for a first set of codewords, where $$ccp(m) = \sum_{n=0}^{N-1} p^{\wedge}(n)V_1(m,N-1-n);\ m = 1 \ldots 7$$

where p (n)=p(N−1−n)×h(n)=Xa(n), and $V_1(m,N-1-n)$ is the mirror signal of the first set of the plurality of sets of basis vector signals, $$\alpha(m) = \sum_{n=0}^{N-1} V_1(m,N-1-n)b^{\wedge}(n)/\Gamma_b'$$

where $b^{\Delta}(n)=b'(m,N-1-n)\times h(n)$, $b'(m,N-1-n)=b(m,N-1-n)\times h(n))$ p(n) is a weighted version of the digital audio speech signals, h(n) is a predetermined filter, and $$\Gamma_b' = \sum_{n=0}^{N-1} b'(n)b'(n)$$

$$CR = \sum_{n=0}^{N-1} p(n)b'(n),$$

where $b'(n)=b(n)\times h(n)$, and the equation $$\theta_m^H = \left\{ \text{SIGN} \sum_{n=0}^{N-1} Xa(n)V_2(m,N-1-n) - \right.$$

-continued $$\left. \delta(m) \sum_{n=0}^{N-1} Xa(n)X1(N-1-n) + CR(\delta(m)a - \beta(m)) \right\}$$

m=1 . . . 7, for a second set of codewords, where $V_2(m,N-1-n)$ is the mirror signal of the second set of the plurality of sets of basis vector signals, $$\beta(m) = \sum_{n=0}^{N-1} V_2(m,N-1-n)b^{\Delta}(n)/\Gamma_b';\ m = 1 \ldots 7$$

$$a = \sum_{m-1}^{7} \theta_m^I \alpha(m)$$

$$X1(n) = \sum_{m-1}^{7} \theta_m^I V_1(m,n)$$

$$Pout = X1(n) \times h(n)$$

$$CS = \sum_{n=0}^{N-1} Pout(n)b'(n)$$

$$\Gamma_z = \sum_{n=0}^{N-1} Pout^2 - a^2\Gamma_b'$$

$$\delta(m) = \sum_{n=0}^{N-1} (Pout\ (n)V_2(m,N-1-n) - \beta(m)cs)/\Gamma_z;$$

$m = 1 \ldots 7$, $Pout\ (n) = Pout(N-1-n) \times h(n)$, and $x$ is the convolution operator.

9. The method of claim 6 wherein the audio input signals comprise speech signals.

10. The method of claim 6 further comprising the step of transmitting the generated codewords to a cellular telephony receiver.

* * * * *